US005503968A

United States Patent [19]

Lee

[11] Patent Number: 5,503,968

[45] Date of Patent: Apr. 2, 1996

[54] FLAME TREATMENT AND CORONA DISCHARGE TREATMENT OF PHOTOGRAPHIC PAPER FOR IMPROVED BOND WITH OZONE TREATED POLYOLEFIN RESIN COATING

[75] Inventor: Jong S. Lee, Pittsford, N.Y.

[73] Assignee: Eastman Kodak Company, Rochester, N.Y.

[21] Appl. No.: 313,636

[22] Filed: Sep. 27, 1994

[51] Int. Cl.[6] ..... G03C 1/775

[52] U.S. Cl. ..... 430/532; 430/531; 430/538; 427/223; 427/326; 427/535; 427/561; 528/483; 528/490

[58] Field of Search ..... 430/532, 538, 430/531; 427/326, 223, 535, 561; 528/483, 490

[56] References Cited

U.S. PATENT DOCUMENTS 3,892,573 7/1975 Tatsuta et al. .
4,128,426 12/1978 Ohta et al. .
4,135,932 1/1979 Mann .
4,186,018 1/1980 Minagawa et al. ..... 430/532
4,481,289 11/1984 Honma ..... 430/532
4,729,945 3/1988 Anthonsen et al. ..... 430/538
5,147,678 9/1992 Foerch et al. ..... 427/40

*Primary Examiner*—Charles L. Bowers, Jr.
*Assistant Examiner*—Christopher G. Young
*Attorney, Agent, or Firm*—Robert A. Gerlach

[57] ABSTRACT

A method of making resin coated photographic paper which comprises providing a paper base, subjecting the paper base to a flame treatment and a corona discharge treatment, providing a polyolefin melt curtain, treating the polyolefin resin melt curtain with a mixture of ozone and air and bringing the paper base in contact with the polyolefin melt curtain to provide a uniform layer of polyolefin resin on the paper base.

8 Claims, 2 Drawing Sheets

FIG. 3
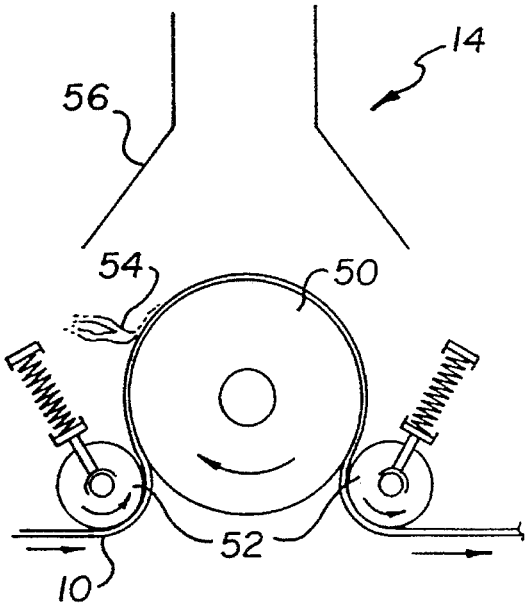
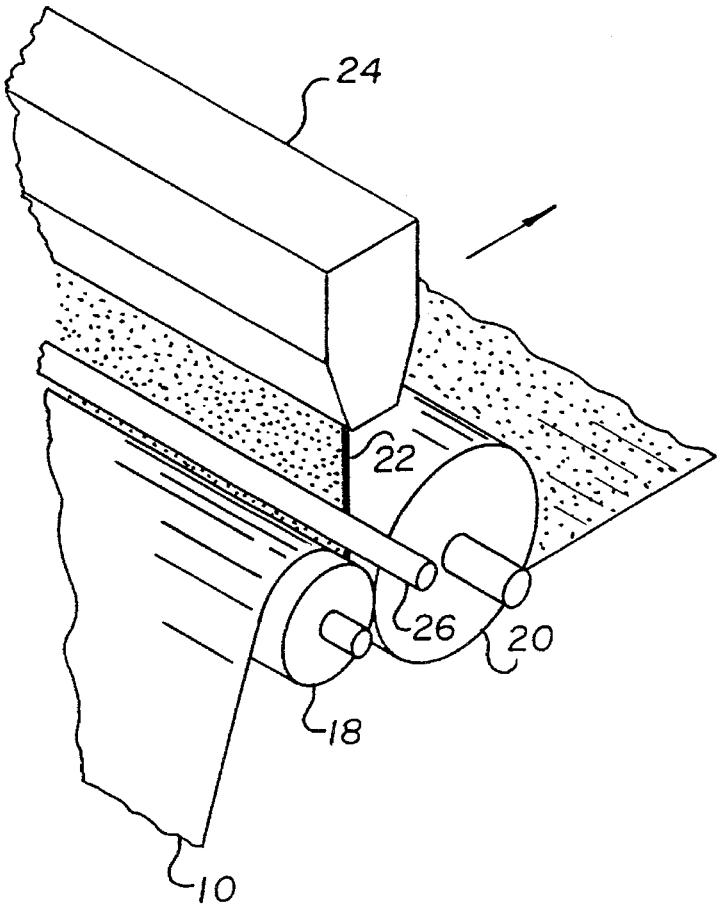
FIG. 4

FLAME TREATMENT AND CORONA DISCHARGE TREATMENT OF PHOTOGRAPHIC PAPER FOR IMPROVED BOND WITH OZONE TREATED POLYOLEFIN RESIN COATING

BACKGROUND OF THE INVENTION

1. Field of the Invention

This invention relates to a method for manufacturing a photographic paper support having a resin coating thereon. More particularly, it relates to a method of making a resin coated photographic paper having improved adhesion between the resin layer and the paper surface.

2. Description of Related Art

In order to keep the processing solution from penetrating photographic paper base during the development steps, synthetic resins of the polyolefin type such as polyethylene and polypropylene are coated on paper. The side to be coated with photographic emulsion has inorganic fillers such as titanium dioxide to provide white background. The opposite side has generally a blend of low density and high density polyethylene for curl control purpose. Since polyolefins are nonpolar by nature, extra steps are required to promote good bond between a polyolefin and paper surface. One method is to oxidize the molten polyolefin curtain prior to the coating. Polymer melt temperature is kept as high as 338° C. (640° F.) to promote oxidation. But the high melt temperature produces unwelcome results such as polymer degradation and crosslinked gel formation. The distance between the die lip and the lamination nip can be adjusted to provide longer oxidation time. But too great distance can hurt oxidation because it will lower the melt temperature. The coating line speed can be reduced to allow more time for oxidation. But this is not attractive from the cost point of view.

Another method is to precoat paper with adhesion promoting chemical primers. However, because the photographic paper is a rather porous substrate, the priming solution soaks through the paper rather than staying on the surface. Also photosensitivity of chemical primers is another concern.

There are other means of treating substrate surfaces. U.S. Pat. Nos. 5,147,678; 3,892,573; 4,135,932; 4,729,945; 4,186,018; and 4,128,426 describe treating polymeric surface using flame, corona, or ozone to improve on adhesion. U.S. Pat. No. 4,481,289 describes treating paper surface with corona discharge and oxidizing the polyolefin melt curtain using ozone and air mixture. It claimed that, by this method, improved adhesion was observed at 183 m/min (600 FPM) line speed. A line speed of 183 m/min is rather slow in today's environment. There is a great need to increase the line speed to 457 m/min (1,500 FPM) or beyond.

SUMMARY OF THE INVENTION

The invention contemplates a method of making resin coated photographic paper which comprises providing a paper base, subjecting the paper base to a flame treatment and a corona discharge treatment, providing a polyolefin melt curtain, treating the polyolefin resin melt curtain with a mixture of ozone and air and bringing the paper base in contact with the polyolefin melt curtain to provide a uniform layer of polyolefin resin on the paper base. The paper base may, in addition, be treated with a corona discharge. Significant improvement in adhesion between a polyolefin resin and paper is achieved in accordance with this invention.

The process in accordance with this invention provides excellent adhesion of the polyolefin resin to the paper substrate at speeds greatly exceeding that heretofore known.

BRIEF DESCRIPTION OF THE DRAWINGS

FIG. 3 is a diagrammatic view of an apparatus for conducting the flame treatment in accordance with this invention;

FIG. 4 is a partial perspective view of an apparatus for conducting the ozone treatment in accordance with this invention.

DESCRIPTION OF PREFERRED EMBODIMENTS

Without being bound by any particular mechanism, it is believed that surface moisture in the paper substrate is an important factor influencing adhesion. When the hot polymer melt contacts the paper surface, it raises the paper surface temperature well above the boiling point. The surface moisture then evaporates causing delamination of polyolefin layer from the paper surface. This moisture effect can be minimized by pretreating paper with flame.

Further, by exposing the paper surface to different surface treatments, flame and corona discharge, it is believed that more specific and unique chemical groups are formed which are not formed by corona discharge alone.

Figure 1:
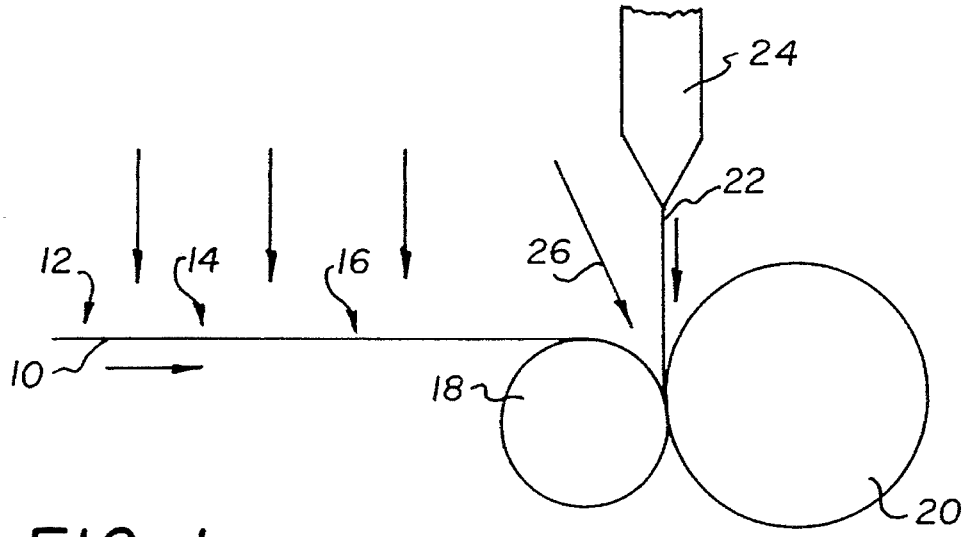
FIG. 1 is a diagrammatic representation of an apparatus for practicing the process of this invention.

Referring to FIG. 1, photographic paper sheet 10 is moving in the direction shown by the horizontal arrow through a first corona discharge treatment zone 12, through a flame treatment zone 14, and then through a second corona discharge treatment zone 16 followed by passing around nip roller 18 and between nip roller 18 and chill roller 20. Chill roller 20 is provided with a matte finish and the pressure applied by rollers 18 and 20 is about 0.4 MPa (60 PSI). The molten polyolefin resin is conveyed in a molten sheet 22 from curtain coating device 24 to impinge upon the paper substrate 10 near the nip of rollers 18 and 20. Ozone coating station 26 is positioned just prior to the entrance of the curtain of molten polyolefin in order that the ozone treats the polyolefin sheet.

In the coating line of FIG. 1, the first corona discharge zone may embody a single horse shoe type electrode, 10.2 centimeters (4 inches) wide and 81.3 centimeters (32 inches) long and a dielectric coated roll. The first corona discharge treatment may be one provided by Pillar Technology, rated at 110 kHz and 12 kW. The second corona discharge treatment zone is located about 91.4 centimeters (3 feet) away from the first nip pressure roll 18 and has 6 electrodes with a bare roll. A suitable device of this type is supplied by Enercon and is rated at a 110 kHz and 12 kW.

Figure 2:
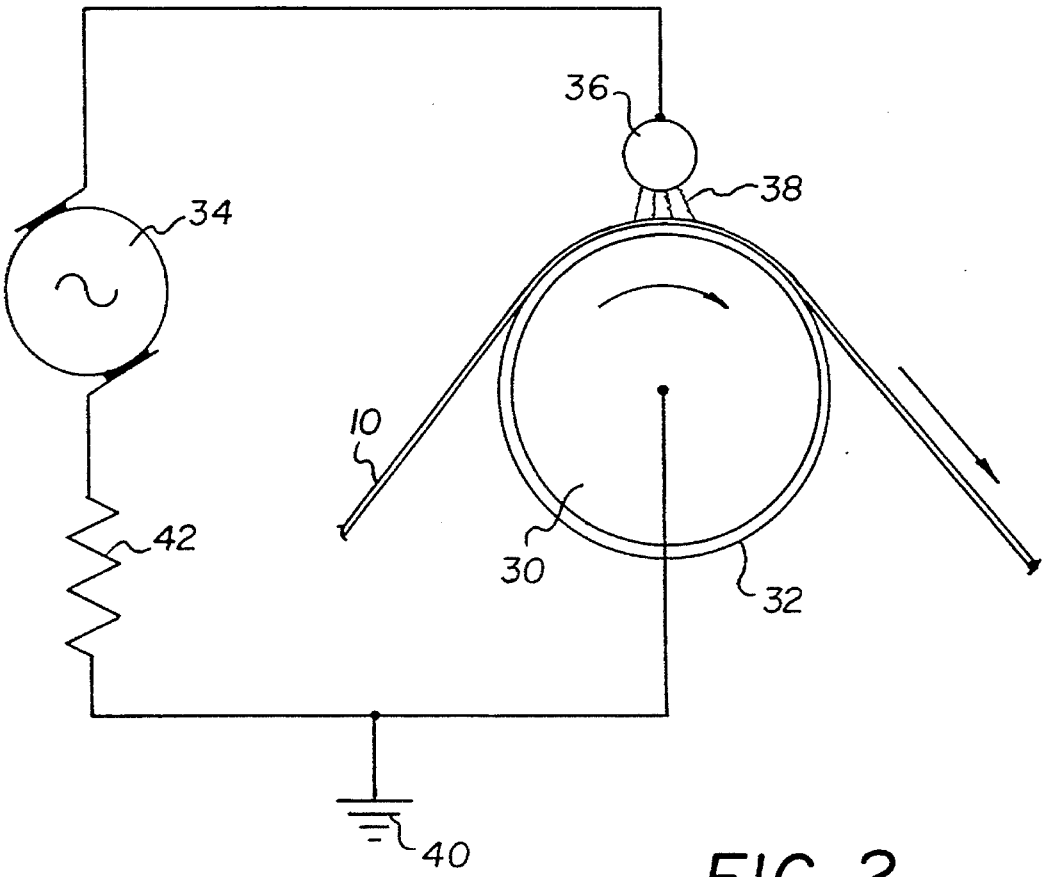
FIG. 2 is a diagrammatic view of an apparatus for conducting the corona discharge treatment in accordance with this invention.

A typical configuration for corona discharge treating at positions 12 or 16, in accordance with this invention is shown schematically in FIG. 2. The paper substrate 10, to be treated, passes over a grounded roll 30, which roll 30 may or may not be coated with a dielectric material 32. A generator 34, such as a high frequency spark generator supplies a high voltage to electrode 36 which jumps the gap between the electrode 36 and the substrate 10 causing a corona discharge 38 upon the surface of the substrate 10. The circuit is completed by the connection of the metal roll 30 to ground 40 and then through resistor 42 back to the generator.

The high voltage fields cause the oxygen molecules to break up into ions and electrons which react with the surface of the substrate. Those that do not react, recombine into molecules with either two atoms (normal oxygen) or three atoms (unstable reactive ozone).

Power input for the surface treatment is defined by watt density formula.

$$Wd=PS/(WE\times LS\times NST)$$

Where:

Wd=Watt Density (watts/sq. meter/minute)

PS=Power Supply (watts)

LS=Line Speed (meters/minute)

NST=Number of Sides Treated

WE=Width of Electrode

Watt density can range from 0.18 to 11 watts/$m^2$/min. (0.017 to 1.0 watts/sq. ft./min.), preferably 1.5 to 6.2 watts/$m^2$/min. (0.143 to 0.57 watts/sq. ft./min.).

FIG. 3 is a diagrammatic representation of a suitable apparatus for conducting the flame treatment in accordance with this invention. The flame treating zone 14 receives the continuous substrate 10 from the first corona discharge treating zone 12 in FIG. 1 and the substrate 10 passes over roll 50 where it is held under tention by means of tention rolls 52. The surface of the paper substrate 10 is treated with flame 54, which treatment takes place under an exhaust hood 56. The paper after passing over roll 50 and being subjected to the flame then moves continuously to the next station, which is shown in FIG. 1 is the second corona discharge treatment zone 16. While two corona treating stations are preferred, the corona treatment is optional in this invention.

In flame treating, the high temperature of the combustion gases causes the molecules of oxygen to come apart to form free oxygen atoms that are chemically very reactive. They also lose electrons to become positively charged oxygen ions. The electrically neutral gas made up of equal amounts of positively charged particles and negatively charged particles is known as "plasma." In flame treating, these high speed, energetic, very reactive oxygen ions and free electrons bombard the substrate surface and react with the molecules. This process can be said to oxidize the surface, and requires an oxidizing flame which is a flame with excess oxygen.

The quality of air can vary from time to time. There is a significant reduction of oxygen and an increase in water vapor in the air when the relative humidity is higher. The quality of commercially available gas can vary also due to changes in composition of the supply source. It can also change if the gas company adds propane and air to natural gas at peak loads. The type of gas can be natural gas, propane, or any other hydrocarbon gas. The moving paper web 10 carries with it a boundary layer of air. At high speeds, the flame 54 tends to mix with the boundary layer of air. To compensate for this extra air, the air/gas mixture should be richer in gas at higher line speeds than would be optimal at slow speeds in order to end up at proper plasma readings. For consistency of flame, a flame plasma analyzer is used. A small continuous sample of air/gas mixture was taken and burned into a controlled flame in a closed chamber within the analyzer. The flame plasma produces an electrical signal which is processed to produce the plasma value. The plasma value is an accurate, reproducible measure of the treating ability of an air/gas mixture. Depending on the web speed, the plasma value should be kept from 30 to 80, preferably 45 to 60. The lower the plasma value, the leaner air/gas mixture becomes.

The output of the burner must be increased as the speed of the web is increased to 914 M/min. (3,000 FPM) or higher in order to achieve the same level of treat. The output can range from 1 to 3970 Kg-cal/cm (10 to 40,000 Btu/inch), preferably 3.97 Kg-cal/cm to 1990K (40 to 20,000 Btu/inch). The burner/web gap should be increased with increased burner output so that the plasma portion of the flame, which is just beyond the unburnt cones of air/gas mixture, is just at the web surface.

The distance between the tip of the cone and the moving web can be 0–10.2 cm (0 to 4 inches), preferably 0.254 cm to 5.08 cm (0.1 to 2 inches). The angle at which the tip of the cone contacts the moving web can be 30 to 90 degrees, preferably 45 to 90 degrees. The triple slot design ribbon burners were used, but any other types of commercially available burner can be used. A suitable flame treating device supplied by Wise Corporation has double burner heads (triple slots).

A suitable configuration for the application of ozone to the polyolefin melt is shown in FIG. 4. The paper substrate 10 which exits the second corona discharge treatment zone 16 passes over nip roll 18 and through the nip provided by roll 18 and chill roll 20. Polyolefin curtain coating extrusion die 24 provides a continuous sheet of molten polyolefin into the nip provided by rolls 18 and 20. The extrusion die 24 has a die gap of 0.076 cm (0.03 inch). Immediately above the nip is situated an ozone applicator 26 which treats the surface of the extruded polymer melt curtain with an ozone air mixture. The polyolefin-coated paper exits this zone in the direction shown by the arrow.

Ozone ($O_3$) is a three atom allotrope of oxygen ($O_2$), which is typically formed from oxygen by either electrical discharge (as during lightning) or UV irradiation at specific wavelengths. The basic equation for the formation of ozone is $$3\ O_2 \leftrightarrows 2\ O_3 \Delta H=68\ K\ cal$$

This is an endothermic process and therefore the equilibrium between $O_2$ and $O_3$ is shifted towards $O_2$ with increased temperature. The rate of ozone being generated in an ozonator decreases as temperature, pressure, and flow rate of incoming feed stock of air increases. Ozone oxidizes and deqmsefmts organic and inorganic substances at a higher rate than other reagents. Ozone is the second most powerful oxidant after fluorine. This powerful oxidation nature is being used to treat the polymer melt curtain for improved adhesion.

Ozone is a very unstable compound. Its half life at 21° C. and 1 atmospheric pressure (70° F./14.7 psi) is about 20 minutes. It will be totally degraded at 220° C. (428° F.). The temperature of the ozone-containing gas applied to the polymer melt curtain should be closely controlled to be within the range between 25° and 205° C. (80° and 400° F.), preferably 37.8° C. and 121° C. (100° and 250° F.). If the gas temperature exceeds 204° C. (400° F.), the decomposition of ozone will be accelerated, whereas if it is below 26.6° C. (80° F.), it will decrease the temperature of the polymer melt curtain. In both cases, the efficiency of treatment deteriorates significantly.

The distance between the ozone/air applicator and the extruded polymer melt curtain can be kept from 0.254 cm to 7.62 cm (0.1 to 3.0 inches), preferably 0.50 cm to 2.54 cm (0.2 to 1.0 inches). If the distance is too short, it will affect melt curtain stability, while if the distance is too great, the efficiency of treatment drops significantly. The amount of ozone applied to the polymer melt curtain can range from 2 to 323 mg/$m^2$ (0.2 to 30 mg per square feet), preferably 10.8–108 mg/m$^2$ (1 to 10 mg per square feet). If the amount is too low, degree of oxidation deteriorates, while if it exceeds 30 mg, the excess ozone in the ambient air can become health hazards to operating personnel.

A suitable ozonator is provided by Enercon Industries Corporation. An Enercon Compack 2,000 supplied power to the generator (input: 230/460 vac; 10/5 amps, 115 vac; 20 amps, output: 0 to 2 kW). A 2.54 cm (1 inch) diameter pipe with holes along the lengthwise direction (FIG. 4) was installed about 5.08 cm (2 inches) away from the laminator nip. A piece of plastic tubing running between the pipe and the ozonator carried the ozone/air mixture to the nip area.

In order to determine the efficiencies of the two CDT units, raw stock paper was first resin coated, and then it was passed through the line a second time with only one CDT unit turned on at a time. Using the dyne solutions, surface energies were checked: 46 dynes/cm from corona treatment 12 and 58 dynes/cm from corona treatment 16.

The invention is further illustrated by the following examples:

EXAMPLE 1

In this example, a base paper sheet, Kodak Coloredge photographic paper, 48.98 Kg/279 m$^2$ (108 lb./3,000 sq. ft. in basis weight), was extrusion coated with NA 219 (LDPE by Quantum Chemicals, 0.923 gms/cc, 10 MI). The melt temperature was kept at 288° C. (550° F.). The line speed was at 305 m/min. (1,000 FPM). Different modes of surface treatment were applied. Neither corona discharge treatment (CDT) on paper alone, nor CDT on paper along with ozone/air treatment of polyethylene melt produced any bond at all. However, an excellent bond was achieved when the paper was treated with both CDT and flame, and the polyethylene melt curtain was treated with ozone/air mixture.

| Sample No. | Resin | Paper | Melt Temp. °C. | Line Speed (m/min.) | Air Gap (cm) | Coverage (Kg/92.9 m$^2$) | Surface Treatments | Adhesion |
|---|---|---|---|---|---|---|---|---|
| 1 | NA219 | A | 288 | 304.8 | 22.9 | 3.6 | #2 CDT, Flame, Ozone | Exc. |
| 2 | " | " | " | " | " | " | #2 CDT, Ozone | No |
| 3 | " | " | " | " | " | " | #1 CDT, Ozone | No |
| 4 | " | " | " | " | " | " | #1 CDT | No |
| 5 | " | " | " | " | " | " | #2 CDT | No |
| 6 | " | " | " | " | " | " | #2 CDT, Flame, Ozone | Exc. |

EXAMPLE 2

A medium density polyethylene was prepared by blending 54 parts using LDPE and 46 part using HDPE. The melt temperature was raised to 315.6° C. (600° F.) in order to maintain melt curtain stability. In order to see the effect of flame treatment, it was turned on and off during the experiment. When the flame treater was turned off, the adhesion went from "excellent" to "no-bond."

| Sample No. | Resin | Paper | Melt Temp. °C. | Line Speed (m/min.) | Air Gap (cm) | Coverage (Kg/92.9 m$^2$) | Surface Treatments | Adhesion |
|---|---|---|---|---|---|---|---|---|
| 7 | LDPE/ HDPE | A | 315.6 | 311 | 21.59 | 2.8 | #1 CDT, Flame, Ozone | Exc. |
| 8 | LDPE/ HDPE | " | " | " | " | " | #1 CDT, Ozone | No |

EXAMPLE 3

With the same resin used in Example 2, different line speed trials were made using a little heavier basis weight paper, type 'B'. This time, the CDT unit was turned on and off during the run. Shutting the CDT, increased line speed from 335.3 m/min. to 427 m/min. (1,100 FPM to 1,400 FPM), and lowering coverage from 4.54 Kg/92.9 m$^2$ (10 lb./1,000 sq. ft.) to 3.86 Kg/92.9 m$^2$ (8.5 lb./1,000 sq. ft.) did not affect the adhesion. The bond remained "excellent."

| Sample No. | Resin | Paper | Melt Temp. °C. | Line Speed (m/min.) | Air Gap (cm) | Coverage (Kg/92.9 $m^2$) | Surface Treatments | Adhesion |
|---|---|---|---|---|---|---|---|---|
| 9 | LDPE/ HDPE | B | 329.4 | 335.3 | 21.59 | 4.54 | #2 CDT, Flame, Ozone | Exc. |
| 10 | LDPE/ HDPE | " | " | 426.7 | " | 3.86 | Flame, Ozone | Exc |

EXAMPLE 4

With the same resin used in Example 2, different line speed trials were made using type 'A' paper 48.98 Kg/279 $m^2$ (108 lb./3,000 sq. ft. basis weight). The melt temperature was 329.4° C. (625° F.). All three treatment devices (CDT, flame and ozone/air) were kept turned on during the experiment. Excellent bond was achieved at 426.7 m/min. (1,400 FPM) line speed. Much higher line speed was possible.

| Sample No. | Resin | Paper | Melt Temp. °C. | Line Speed (m/min.) | Air Gap (cm) | Coverage (Kg/92.9 $m^2$) | Surface Treatments | Adhesion |
|---|---|---|---|---|---|---|---|---|
| 11 | LDPE/ HDPE | A | 315.6 | 365.8 | 21.59 | 4.3 | #2 CDT, Flame, Ozone | Exc. |
| 12 | LDPE/ HDPE | " | 329.4 | 426.7 | " | 3.18 | #2 CDT, Flame, Ozone | " |

What is claimed is:

1. A method of making resin coated photographic paper which comprises providing a paper base, subjecting the paper base to a flame treatment and a corona discharge treatment providing a polyolefin melt curtain, treating the polyolefin resin melt curtain with ozone and bringing the paper base in contact with the polyolefin melt curtain to provide a uniform layer of polyolefin resin on the paper base.

2. The method of claim 1 wherein the paper base is treated with two corona discharges, one on either side of the flame treatment.

3. The method of claim 1 wherein the treating flame has a plasma value of from 30 to 80.

4. The method of claim 3 wherein the flame output ranges from 1 to 3970 kg-cal/cm.

5. The method of claim 1 wherein the temperature of the mixture of ozone and air at the polyolefin melt curtain is from 25° to 205° C.

6. The method of claim 1 wherein the power input in watt density of the corona discharge is from 0.18 to 11 wats/$m^2$/min.

7. The method of claim 1 wherein the treating step with ozone is a mixture of ozone and air.

8. The method of claim 1 wherein the quantity of ozone is from 2 to 323 mg/$m^2$.

* * * * *